US006380699B2

(12) United States Patent
Miyazaki et al.

(10) Patent No.: US 6,380,699 B2
(45) Date of Patent: Apr. 30, 2002

(54) COLOR DISPLAY TUBE DEVICE

(75) Inventors: Shunichi Miyazaki; Etsuji Tagami, both of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/729,396

(22) Filed: Dec. 4, 2000

(30) Foreign Application Priority Data

Dec. 22, 1999 (JP) ..... 11-364673

(51) Int. Cl.[7] ..... H01F 1/00

(52) U.S. Cl. ..... 315/368.28; 315/368.27; 313/431; 313/440

(58) Field of Search ..... 315/364–366, 315/368.25–368.28; 313/412, 413, 428–431, 441–443

(56) References Cited

U.S. PATENT DOCUMENTS

| | | | | |
|---|---|---|---|---|
| 5,455,483 A | * | 10/1995 | Azzi et al. | 313/431 |
| 5,804,928 A | | 9/1998 | Endo | 315/400 |
| 5,818,160 A | * | 10/1998 | Ter Burg et al. | 313/440 |
| 6,084,490 A | * | 7/2000 | Azzi et al. | 313/440 |
| 6,215,257 B1 | * | 4/2001 | Choe | 315/368.28 |

FOREIGN PATENT DOCUMENTS

| | | |
|---|---|---|
| JP | 63-80756 | 5/1988 |
| JP | 6-283115 | 10/1994 |
| JP | 9-149283 | 6/1997 |

* cited by examiner

*Primary Examiner*—Don Wong
*Assistant Examiner*—Wilson Lee
(74) *Attorney, Agent, or Firm*—Merchant & Gould P.C.

(57) ABSTRACT

A first magnet that generates a magnetic field having the same polarity as that generated by a vertical deflection coil during a deflection toward the upper side is provided on a phosphor screen side of the deflection coil and above a horizontal axis. A second magnet that generates a magnetic field having the same polarity as that generated by the vertical deflection coil during a deflection toward the lower side is provided on a phosphor screen side of the deflection coil and below the horizontal axis. A third magnet that generates a magnetic field having the opposite polarity to that generated by the vertical deflection coil during the deflection toward the upper side is provided on the phosphor screen side with respect to the first and second magnets and above the horizontal axis. A fourth magnet that generates a magnetic field having the opposite polarity to that generated by the vertical deflection coil during the deflection toward the lower side is provided on the phosphor screen side with respect to the first and second magnets and below the horizontal axis. Consequently, an upper and lower pincushion distortion and an upper and lower inner pincushion distortion can be corrected in a simple and low-cost manner.

3 Claims, 16 Drawing Sheets

COLOR DISPLAY TUBE DEVICE

BACKGROUND OF THE INVENTION

1. Field of the Invention

The present invention relates to a color display tube device used in a monitor, a television receiver or the like.

2. Description of the Related Art

One of the major image quality factors of a color display tube is a raster distortion. Conventionally, an upper and lower pincushion distortion and a right and left pincushion distortion in edge portions are corrected by a magnetic field of a deflection yoke and a correction circuit of the color display tube device. However, even when these distortions at the top, bottom, right and left edges are optimized, pincushion distortions sometimes remain in the middle of vertical lines or horizontal lines. They are called "a right and left inner pincushion distortion" (see FIG. 6) and "an upper and lower inner pincushion distortion" (see FIG. 7) respectively. "The right and left inner pincushion distortion" also is called "a vertical-line inner pincushion distortion," and "the upper and lower inner pincushion distortion" also is called "a horizontal-line inner pincushion distortion."

In general, when a displacement amount of a position of a luminescent spot on a flat screen is expressed by X(t) and a deflection angle is expressed by θ, X(t) is proportional to tanθ. Therefore, a displacement amount in a horizontal direction increases gradually toward the edge portions in a horizontal direction of a phosphor screen, so as to cause a non-linear distortion, called "S-shaped distortion." This S-shaped distortion is corrected by providing an S-shaped distortion correction circuit. A necessary correction amount of the S-shaped distortion is inversely proportional to a vertical distance from a deflection center to each spot on the phosphor screen. As shown in FIG. 8, since the upper and lower portions of the raster of the color display tube, that is, edge portions 18 of the phosphor screen in the vertical direction is farther from the deflection center than a middle portion 17 (a hatched area), the necessary correction amount of the S-shaped distortion is smaller in the edge portions 18 than in the middle portion 17.

However, although the S-shaped distortion correction circuit of the conventional color display tube device optimizes the S-shaped distortion correction in the middle portion of the phosphor screen in the vertical direction, there is a problem as follows. Because the difference of the necessary correction amount between the middle portion and the edge portions of the phosphor screen in the vertical direction was not considered, the S-shaped distortion was corrected too much in the edge portions, thus causing the right and left inner pincushion distortion. In particular, accompanying the development of flatter front panels and larger deflection angles in the color display tubes, this right and left inner pincushion distortion was becoming a noticeable problem.

In response to such a problem, the invention described in JP 9-149283 A had a configuration that a horizontal deflection current is passed through a saturable reactor and modulated by a vertical deflection current, so that during a deflection toward the upper and lower portions of the raster, i.e., the edge portions in the vertical direction, a total inductance of a horizontal deflection portion becomes smaller in deflecting an electron beam toward the edge portions in the horizontal direction (i.e., in deflecting an electron beam toward the diagonal portions of the phosphor screen), thereby removing the right and left inner pincushion distortion.

A trend toward flatter front panels and larger deflection angles in the color display tubes in recent years has caused a difference of the S-shaped distortion correction amount between the left and right portions and the middle portion in the horizontal direction of the raster, as well as the vertical direction of the raster. As a result, not only the right and left inner pincushion distortion, but also the upper and lower inner pincushion distortion has become a problem. The conventional inner pincushion distortion correction circuit described in the above-mentioned JP 9-149283 A was effective in correcting the right and left inner pincushion distortion, but could not correct the upper and lower inner pincushion distortion. Thus, the distortion conventionally was balanced vertically by tilting a central axis of the deflection yoke in the vertical direction, which was called a vertical tilt.

Alternatively, in JP 6-283115 A and JP 63-80756 U, an upper and lower barrel distortion in the middle portion in the vertical direction was corrected by arranging magnets at four corners of the deflection yoke. However, this system had a problem in that a poor horizontal line convergence of red and blue beams in the middle portion in the vertical direction showed up when correcting the raster distortion, and the installation of the magnets increased manufacturing steps so as to lower a work efficiency.

SUMMARY OF THE INVENTION

It is an object of the present invention to provide a color display tube device with a system for correcting an upper and lower inner pincushion distortion while correcting an upper and lower pincushion distortion, and for achieving a material cost reduction, a reduction of manufacturing steps and a higher work efficiency because it is sufficient that two magnets each are installed on the upper and lower sides.

A color display tube device of the present invention includes a glass bulb having a phosphor screen on an inner surface thereof, an in-line electron gun that is arranged in the glass bulb and irradiates an electron beam on the phosphor screen, and a deflection device that is arranged outside the glass bulb and has a horizontal deflection coil and a vertical deflection coil. A first magnetic field generator for generating a magnetic field having a same polarity as a magnetic field generated by the vertical deflection coil during a deflection toward an upper side is provided above a horizontal axis of the deflection device, and a second magnetic field generator for generating a magnetic field having a same polarity as a magnetic field generated by the vertical deflection coil during a deflection toward a lower side is provided below the horizontal axis of the deflection device. A third magnetic field generator for generating a magnetic field having an opposite polarity to the magnetic field generated by the vertical deflection coil during the deflection toward the upper side is provided above the horizontal axis of the deflection device, and a fourth magnetic field generator for generating a magnetic field having an opposite polarity to the magnetic field generated by the vertical deflection coil during the deflection toward the lower side is provided below the horizontal axis of the deflection device. The first and second magnetic field generators are arranged on a side of the phosphor screen with respect to a peak position of a deflection magnetic field strength of the horizontal deflection coil and the vertical deflection coil in a tube axis direction. The third and fourth magnetic field generators are arranged at a same position as the first and second magnetic field generators or on the side of the phosphor screen with respect to the first and second magnetic field generators in the tube axis direction.

In accordance with this configuration, the magnetic field having the same polarity with that of the vertical deflection coil generated by the first and second magnetic field generators can correct the upper and lower inner pincushion distortion in the middle portion in the vertical direction of the phosphor screen and also over-correct the upper and lower pincushion distortion in the edge portions in the vertical direction, and the magnetic field having the opposite polarity to that of the vertical deflection coil generated by the third and fourth magnetic field generators can recorrect only the distortion in the edge portions in the vertical direction that has been over-corrected, thereby correcting both the upper and lower pincushion distortion in the edge portions and the upper and lower inner pincushion distortion in the middle portion.

In the above configuration, it is preferable that the magnetic field strength of the third and fourth magnetic field generators is smaller than that of the first and second magnetic field generators, and the distance from the third and fourth magnetic field generators to the glass bulb is smaller than that from the first and second magnetic field generators to the glass bulb in a vertical axis direction.

In accordance with this preferable configuration, a magnetic field in an attenuation region of the first and second magnetic field generators can exert substantially equal forces in a correction direction on an electron beam to be deflected toward the edge portions in the vertical direction and an electron beam to be deflected toward the middle portion in the vertical direction, and a magnetic field generated by the third and fourth magnetic field generators can exert a force in a direction opposite to the correction direction only on an electron beam to be deflected toward the edge portions in the vertical direction. Thus, the upper and lower inner pincushion distortion can be corrected very effectively.

Also, in the color display tube device of the present invention, it is preferable that the first to fourth magnetic field generators include magnets.

In accordance with this preferable configuration, the size, shape and magnetic characteristics etc. of the magnets constituting the first and second magnetic field generators and the magnets constituting the third and fourth magnetic field generators are selected suitably, thereby adjusting a correction magnetic field having an effect on the electron beams to be deflected toward the edge portions and the middle portion in the vertical direction of the phosphor screen. Thus, it is possible to correct both the upper and lower pincushion distortion in the edge portions and the upper and lower inner pincushion distortion in the middle portion in a simple and low-cost manner.

DESCRIPTION OF THE PREFERRED EMBODIMENTS

The following is a description of an embodiment of the present invention, with reference to the accompanying drawings.

Figure 2:
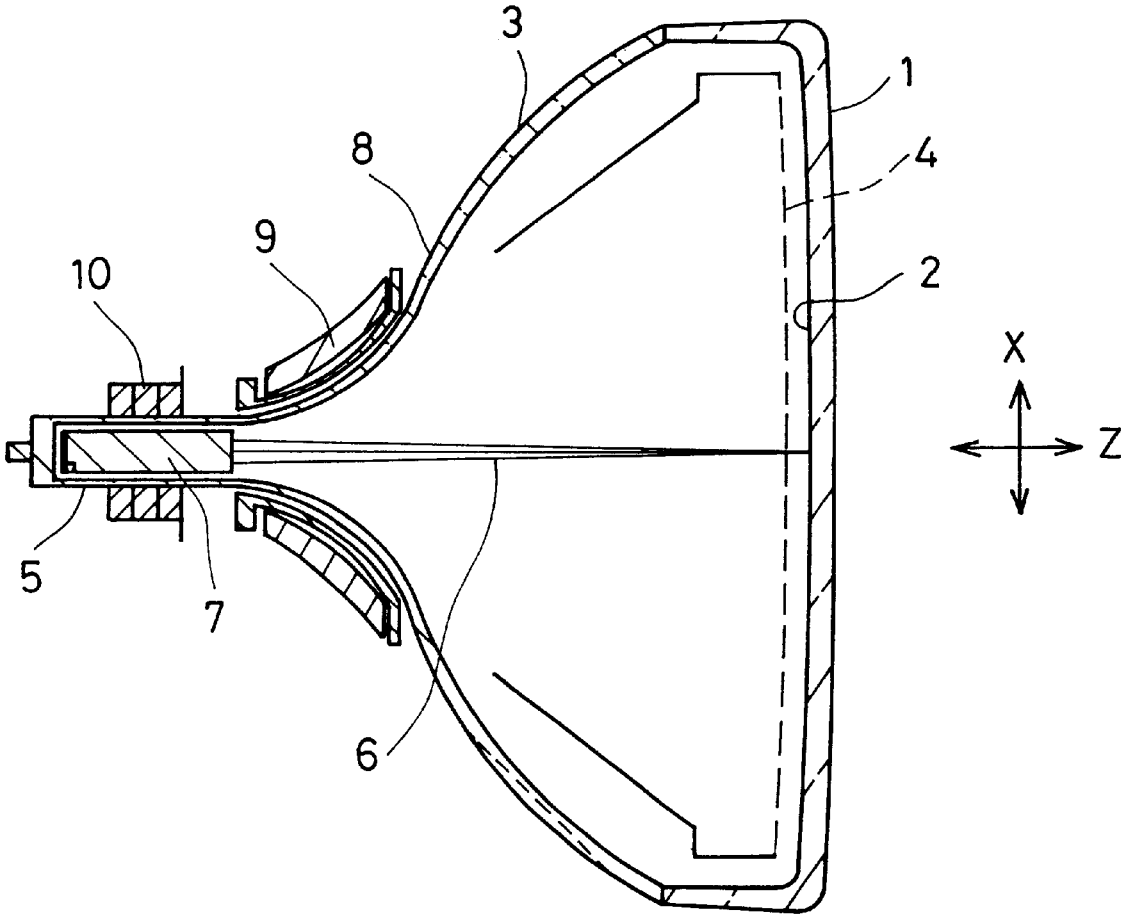
FIG. 2 shows a transverse cross-section of a color display tube device of the present invention.

A color display tube device of the present invention includes a color display tube and a deflection device. As shown in FIG. 2, a color display tube device of the present invention includes a glass bulb 3 provided with a front panel 1 having a phosphor screen 2 that emits blue, green and red lights on an inner surface thereof, a shadow mask 4 that is arranged in opposition to the phosphor screen 2, an in-line electron gun 7 that is arranged in a neck portion 5 of the glass bulb 3 and irradiates electron beams 6 on the phosphor screen 2, and a deflection device 9 disposed on the outer side of a funnel portion 8 and the neck portion 5 of the glass bulb 3. Usually, on the outer side of the neck portion 5, a convergence unit 10 having a two-pole magnet, a four-pole magnet and a six-pole magnet further is mounted for adjusting purity and static convergence.

A three-dimensional rectangular coordinate system wherein an X-axis indicates a horizontal axis crossing a tube axis, a Y-axis indicates a vertical axis crossing the tube axis, and a Z-axis indicates the tube axis will be used for convenience of the description in the following.

Figure 1:
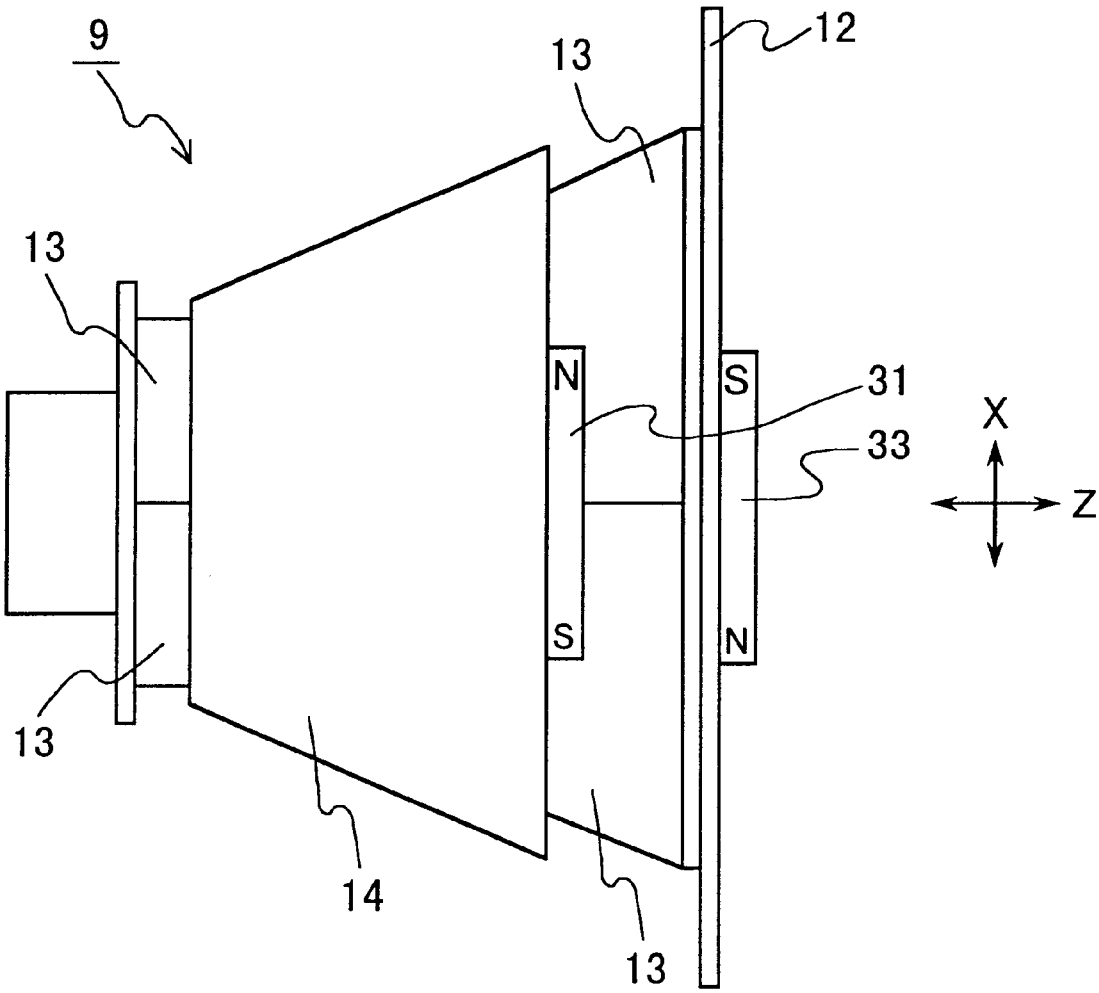
FIG. 1 shows a deflection device of the present invention seen from the upper side.
Figure 3:
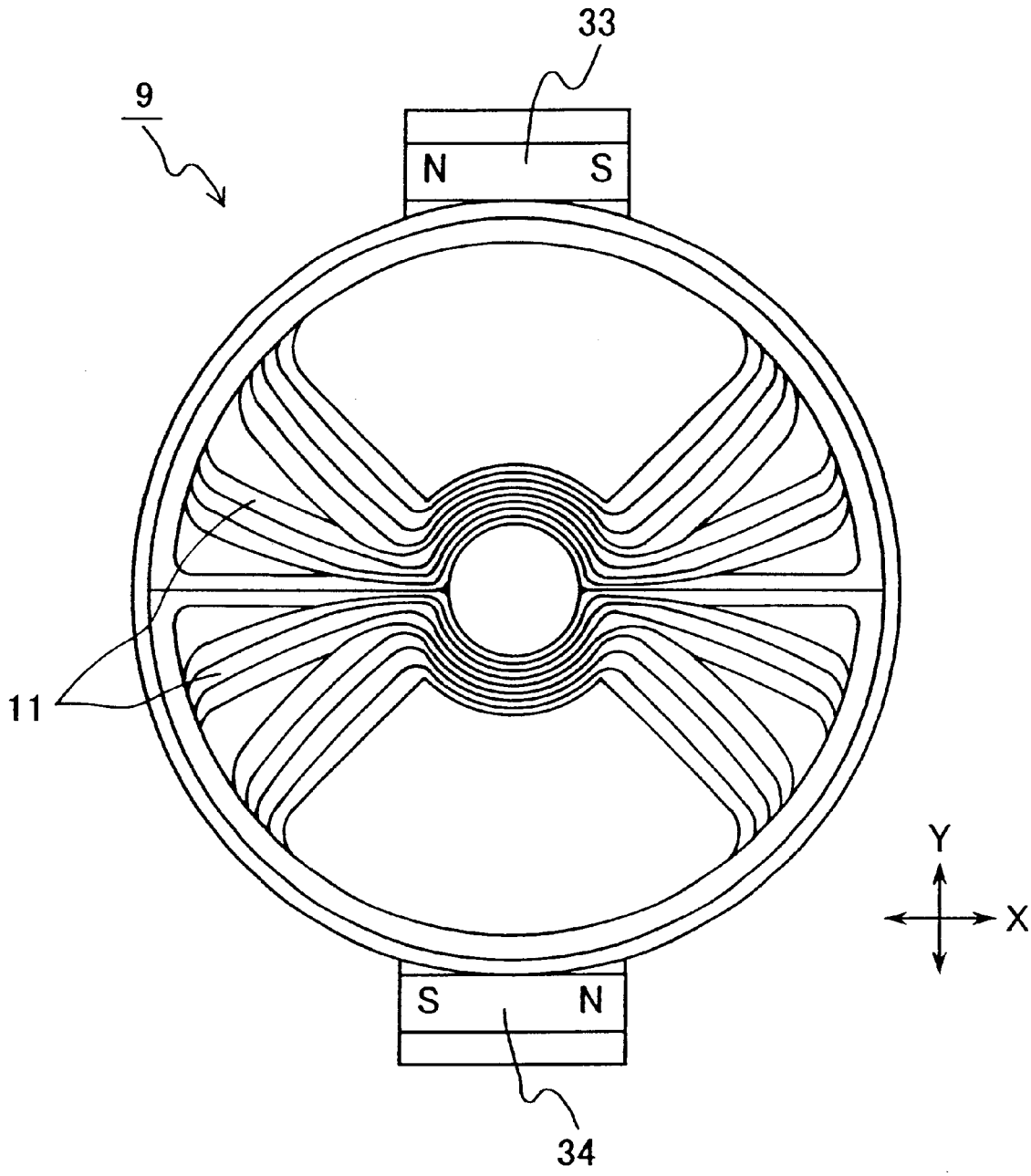
FIG. 3 shows the deflection device of the present invention seen from the side of a phosphor screen.
Figure 12:
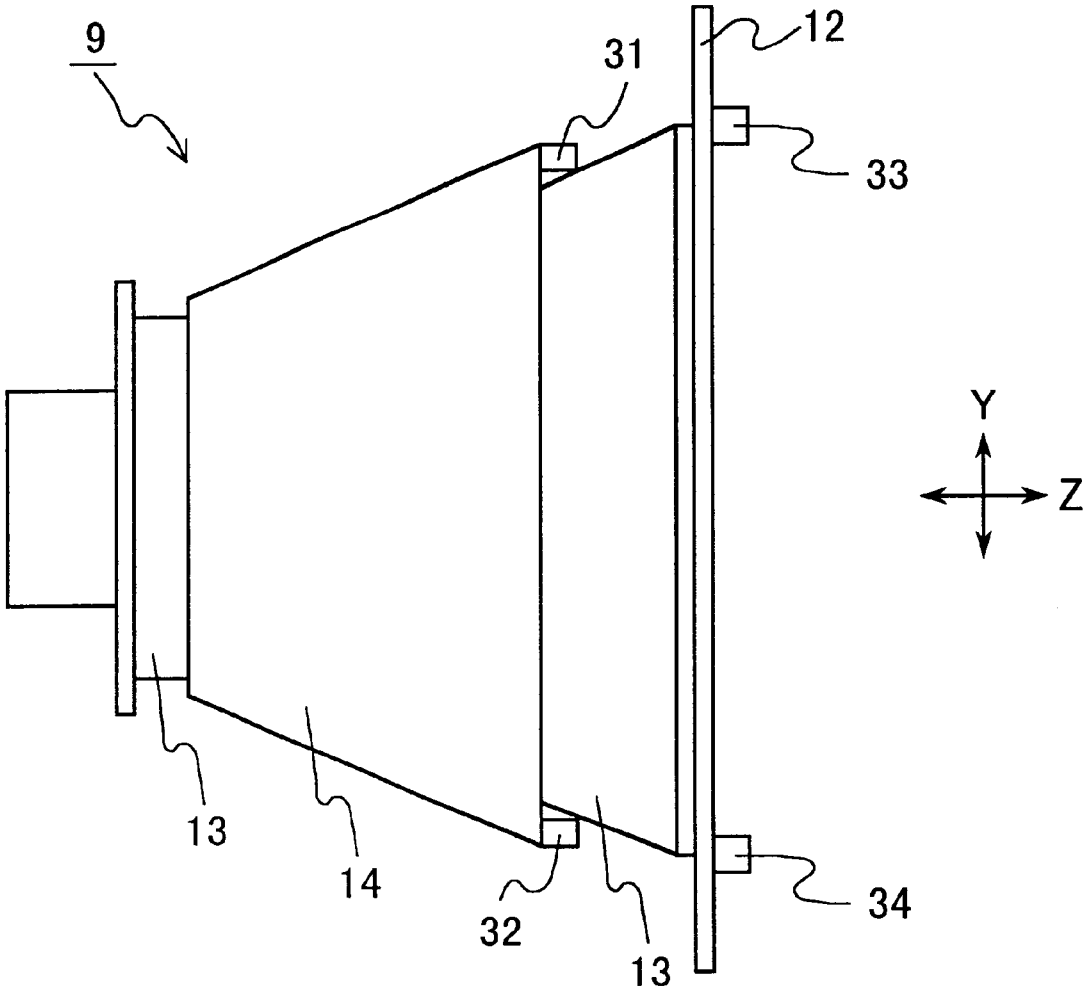
FIG. 12 shows the deflection device of the present invention seen in the lateral direction.

FIG. 1 shows the deflection device 9 seen from the upper side (the N side), FIG. 12 shows the deflection device 9 seen in the lateral direction (the E or W side), and FIG. 3 shows the deflection device 9 seen from the side of the phosphor screen. The deflection device 9 is provided with a pair of horizontal deflection coils 11 that generates a magnetic field having a pincushion distortion as a whole and a pair of vertical deflection coils 13 that are arranged via a resin frame 12 for insulation and support. A ferrite core 14 is disposed on the periphery thereof. Furthermore, on the periphery of an opening of the ferrite core 14 on the phosphor screen side, a magnet 31 as a first magnetic field generator and a magnet 32 as a second magnetic field generator are mounted at upper and lower substantially symmetrical positions. Also, on the periphery of an opening of the vertical deflection coils 13 on the phosphor screen side, a magnet 33 as a third magnetic field generator and a magnet 34 as a fourth magnetic field generator are mounted at upper and lower substantially symmetrical positions. These magnets 31 to 34 all are placed on the phosphor screen side with respect to the ferrite core 14 and on the phosphor screen side with respect to a peak position of a deflection magnetic field strength in the tube axis direction. It is known that the peak position of the deflection magnetic field strength is defined by a superposition of magnetic fields of three members constituting the deflection coil (an arc portion on the electron gun side, a cone portion and an arc portion on the screen side), so as to be located near an inflection point from a cylindrical portion (a portion substantially parallel to the tube axis) to a curved portion (a portion expanding gradually along the funnel) in the cone portion of the deflection coil.

Figure 4:
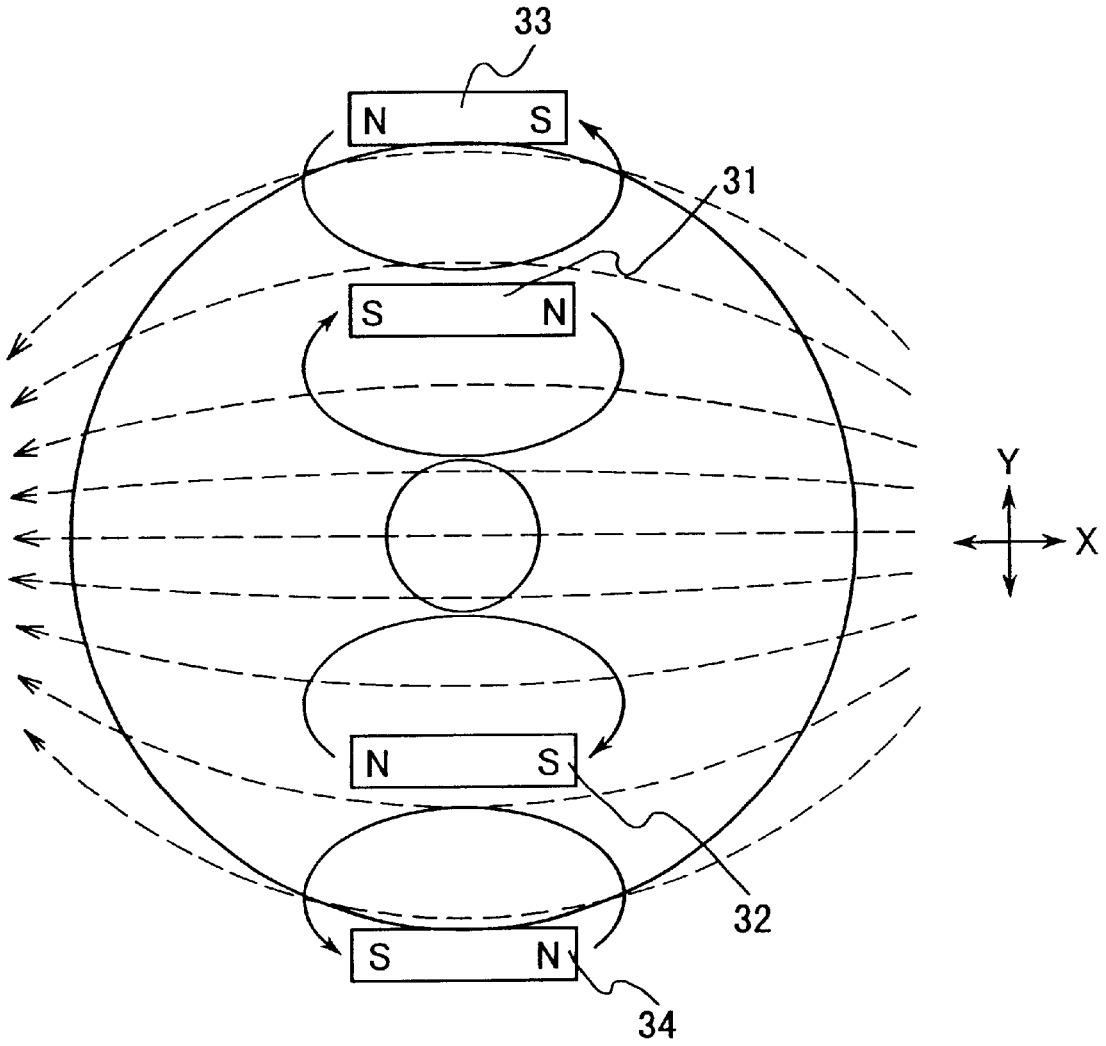
FIG. 4 shows a relationship between directions of a magnetic field generated by magnetic field generators (correction magnets) of the present invention and a vertical deflection magnetic field.

FIG. 4 shows magnetic fields seen in a direction parallel to the tube axis when deflecting an electron beam toward the upper portion of the phosphor screen. The magnetic field generated by the first magnet 31 has the same polarity as the magnetic field (shown with dashed lines) generated by the vertical deflection coil (not shown in the drawing), while the magnetic field generated by the third magnet 33 has a polarity opposite thereto. The second magnet 32 is arranged so as to generate the magnetic field in a direction opposite to that generated by the first magnet 31, and the fourth magnet 34 is arranged so as to generate the magnetic field in a direction opposite to that generated by the third magnet 33.

Figure 5:
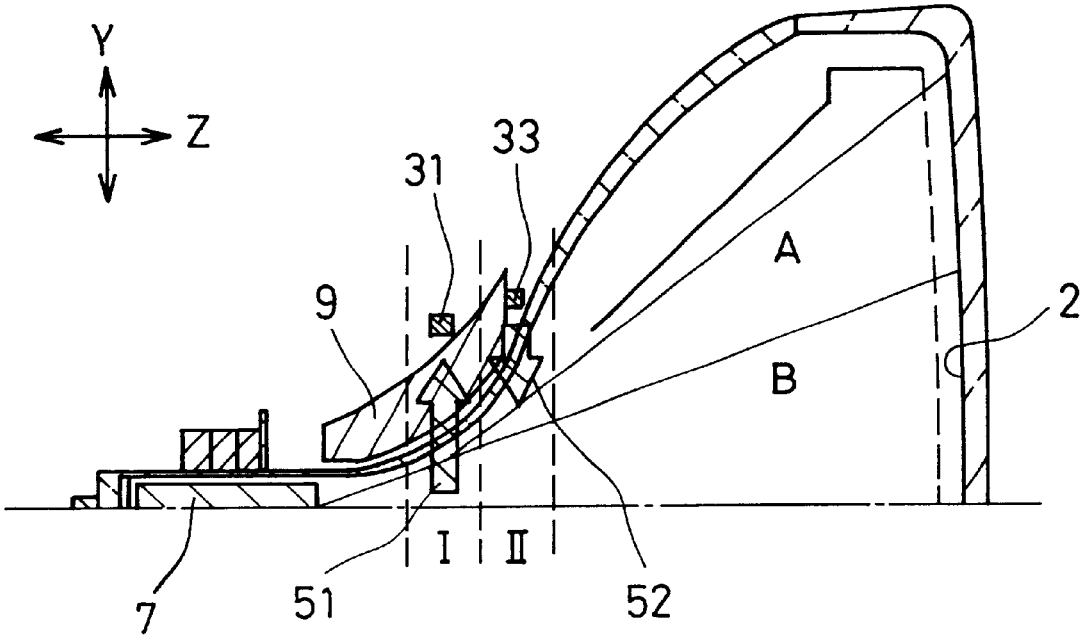
FIG. 5 shows how an upper and lower inner pincushion distortion is corrected by the magnetic field generators (correction magnets) of the present invention.
Figure 6:
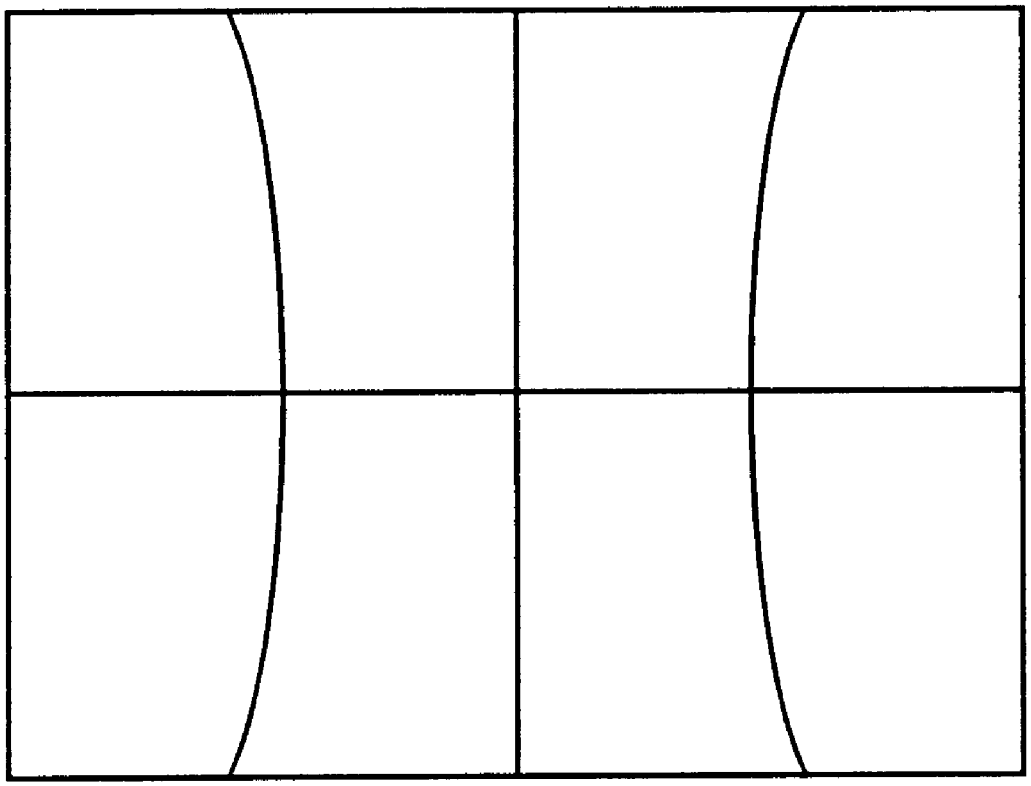
FIG . 6 PRIOR ART
FIG. 6 illustrates a right and left inner pincushion distortion.
Figure 7:
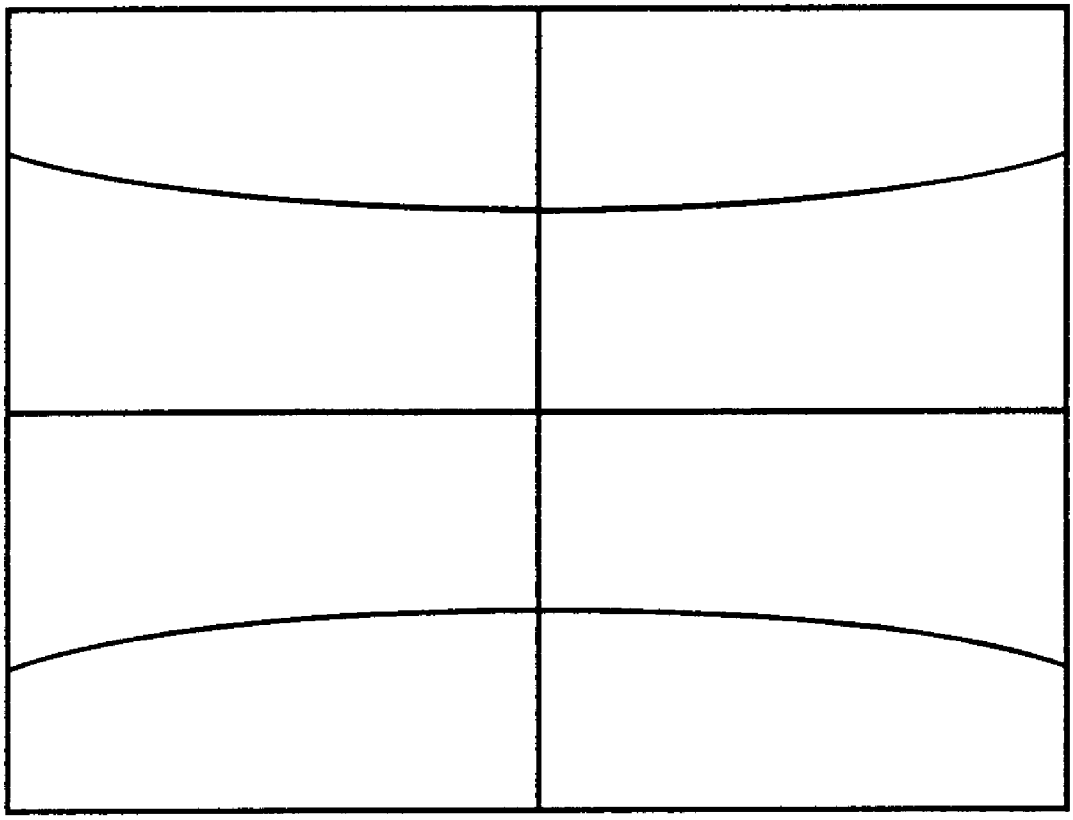
FIG . 7 PRIOR ART
FIG. 7 illustrates an upper and lower inner pincushion distortion.
Figure 8:
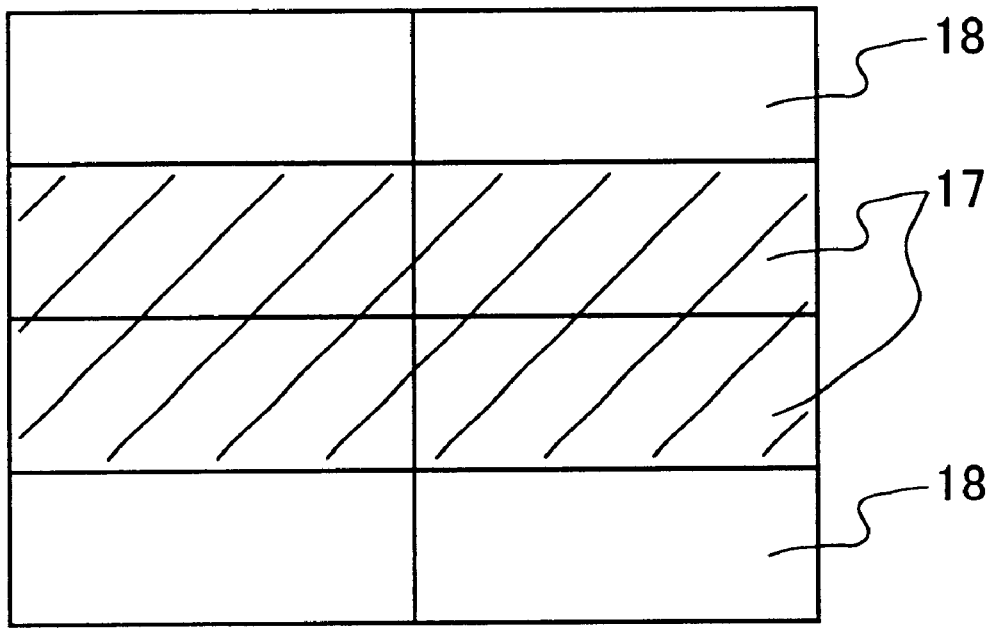
FIG. 8 illustrates edge portions and a middle portion in the vertical direction of the phosphor screen.

FIG. 5 shows how an upper and lower inner pincushion distortion is corrected by the present invention. An electron beam emitted by the in-line electron gun 7 is deflected by the magnetic field generated by the deflection device 9 over an entire region of the phosphor screen 2. When deflected to the upper edge portion of the phosphor screen, the electron beam travels along a track A, and when deflected to the upper middle portion, it travels along a track B. When the magnets 31 and 33 generate the magnetic fields having the polarities shown in FIG. 4 respectively, since the tracks A and B are close to each other in a region I on the electron gun side, the magnetic field generated by the first magnet 31 has an effect not only on the electron beam A to be deflected to the edge portion but on the electron beam B to be deflected to the middle portion, so that both of the electron beams are subjected to a force 51 shown by an arrow in the same direction as the deflection direction. On the other hand, since the tracks A and B are spaced away from each other in a region II on the phosphor screen side, the magnetic field generated by the third magnet 33 has an extremely small effect on the electron beam travelling along the track B, so that only the electron beam travelling along the track A is subjected to a force 52 shown by an arrow in the opposite direction to the deflection direction.

Figure 9:
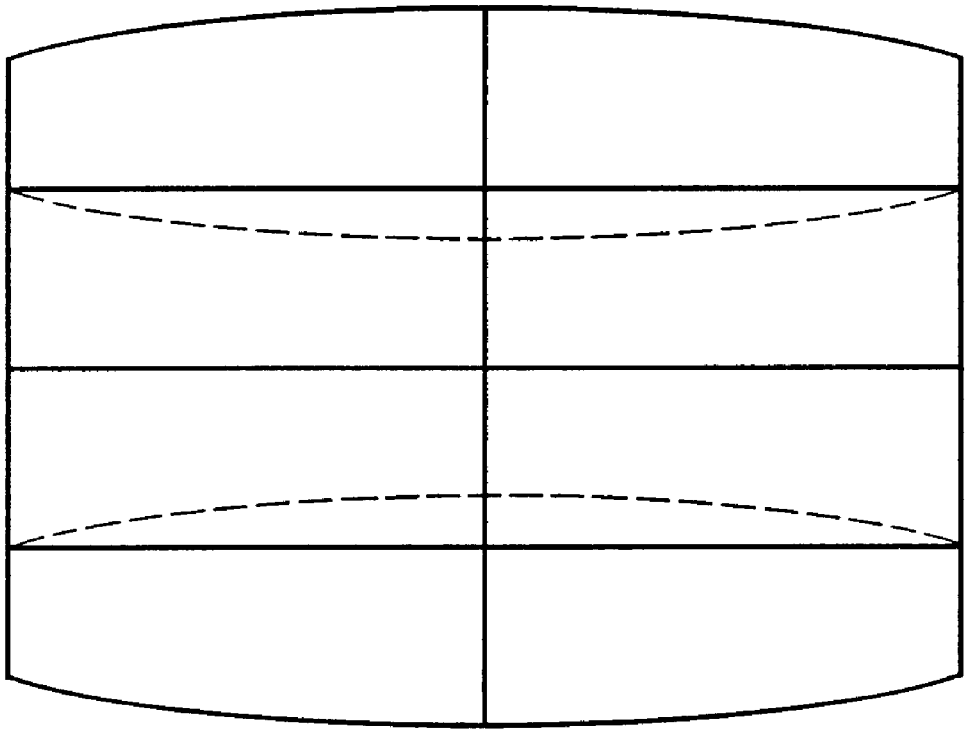
FIG. 9 shows how the upper and lower inner pincushion distortion is corrected by the present invention.
Figure 10:
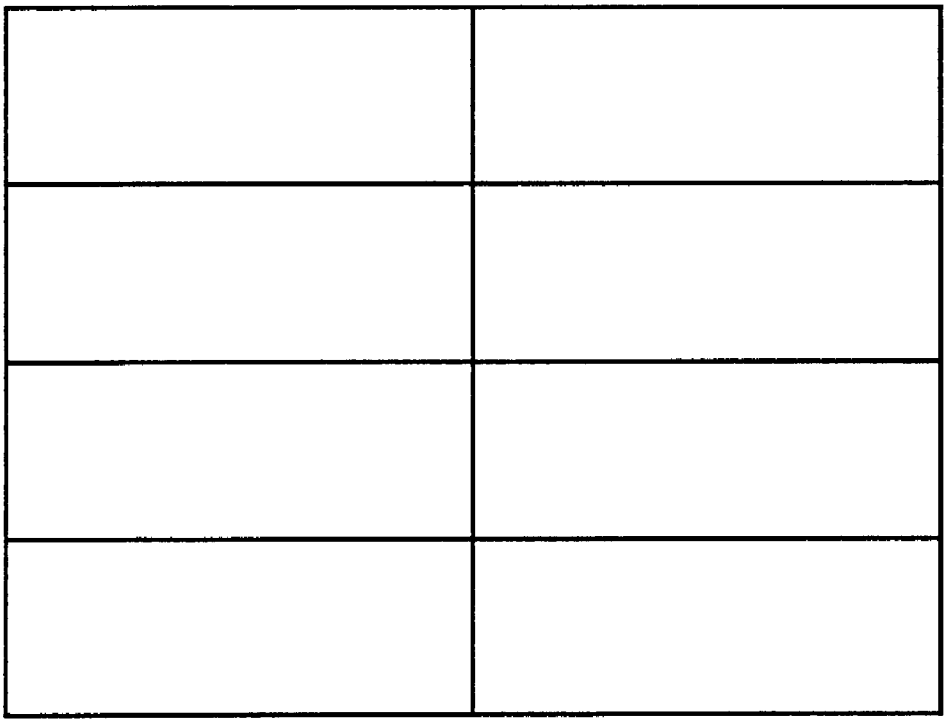
FIG. 10 shows how an upper and lower pincushion distortion further is corrected by the present invention.

FIGS. 9 and 10 show how the upper and lower inner pincushion distortion and an upper and lower pincushion distortion are corrected in stages by the present invention. In FIG. 9, when the upper and lower inner pincushion distortion before a correction shown by dashed lines is corrected optimally as shown in solid lines by the effect of the force 51, the upper and lower pincushion distortion is corrected too much in the edge portions. However, since the edge portions are inversely corrected again by the effect of the force 52, the raster distortion results in an appropriate state as shown in FIG. 10. As described above, it is possible to correct the upper and lower inner pincushion distortion, while optimizing the upper and lower pincushion distortion.

The deflection of the electron beam to the upper side of the phosphor screen has been described above. When deflecting the electron beam to the lower side, on the other hand, the direction of the vertical deflection magnetic field (dashed lines) shown in FIG. 4 is reversed, and the second magnet 32 and the fourth magnet 34 as the magnetic field generators function similarly to the first magnet 31 and the third magnet 33 described above respectively.

Next, the following is a description of an experimental example of confirming the effect of the present invention in a color display tube device for a 46-cm (19 inch)-diagonal display. In the experiment, a 5 mm×5 mm×15 mm magnet with a magnetic field strength of 0.05 T was used for the magnets 31 and 32. A 2 mm×5 mm×10 mm magnet with a magnetic field strength of 0.02 T was used for the magnets 33 and 34. The magnets 31 and 32 were placed at a distance of 28 mm and the magnets 33 and 34 were placed at a distance of 48 mm from the peak position of a vertical deflection magnetic field strength on the phosphor screen side. Both of the magnets were arranged such that their longitudinal directions were parallel to the X-axis direction.

When attempting to optimize the raster distortion only by a deflection magnetic field (a comparative example), the upper and lower pincushion distortion was 0.1 mm and the upper and lower inner pincushion distortion was 0.9 mm, so that the upper and lower inner pincushion distortion was noticeable. On the other hand, when optimizing the distortion using the magnets 31 to 34 of the present invention, the upper and lower pincushion distortion was 0.1 mm and the upper and lower inner pincushion distortion was 0.4 mm. This showed that it was possible to reduce the upper and lower inner pincushion distortion, while maintaining the upper and lower pincushion distortion at the same level as that in the comparative example above.

The magnetic field strength, size and mounting position of the used magnets are determined by considering an entire balance of the raster distortion as follows.

Basically, it is sufficient that the magnetic field strength at a degree that can correct the upper and lower inner pincushion distortion down to substantially zero is generated by the first magnet 31 and the second magnet 32. Also, it is sufficient that the magnetic field strength that can recorrect the over-corrected upper and lower pincushion distortion in the edge portions down to about 0.5 mm or smaller is generated by the magnets 33 and 34.

The size needs to be selected according to the upper and lower raster distortion. This is because, when the magnet is too short in its longitudinal direction, an unnecessary wavy component is generated in the raster distortion, and when it is too long, the correction of only a desired portion becomes difficult.

In terms of the mounting position in the tube axis direction, if the magnets are arranged outside the ferrite core, it is impossible to obtain a substantial correction effect. Therefore, it is preferable that the magnets 31 and 32 are arranged as close as possible to the electron gun in a region on the phosphor screen side with respect to the ferrite core, and that the magnets 33 and 34 are arranged at an end of the deflection device on the phosphor screen side.

It should be understood that, as described above, they need to be adjusted so as to achieve the optimal combination according to the entire balance of the raster distortion.

Figure 11:
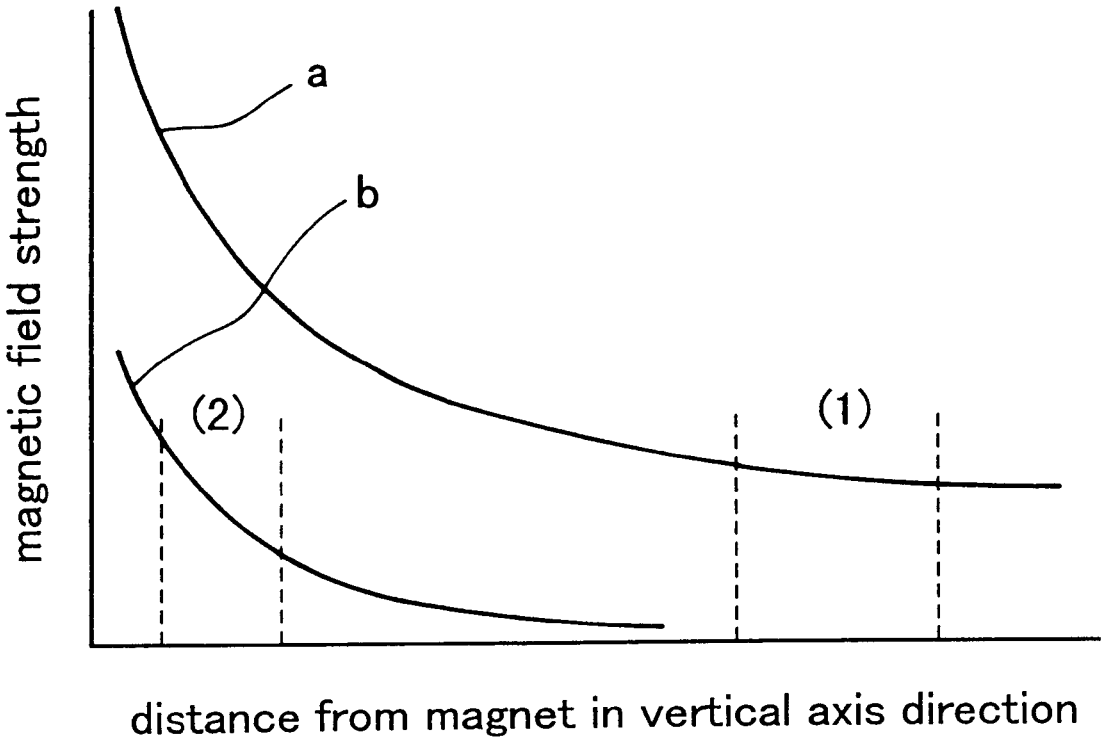
FIG. 11 shows a distribution of a magnetic field strength of the magnetic field generators (correction magnets) used in the present invention in a vertical axis direction.

FIG. 11 shows a distribution of the magnetic field strength of the magnets used in the present invention in a vertical axis direction. A curve a corresponds to a magnet with a large magnetic field strength, and a curve b corresponds to a magnet with a small magnetic field strength. For both magnets, the magnetic field strength drops sharply in a region near the magnets, and its change gradually becomes gentle with an increase in the distance from the magnet. It is further effective that the magnet with a large magnetic field strength is used as the first magnet 31 and the second magnet 32 by spacing it away from the funnel, and that the magnet with a small magnetic field strength is used as the third magnet 33 and the fourth magnet 34 by placing it close to the funnel. This is because, in order to draw the electron beams travelling along the tracks A and B toward the periphery with forces as equal as possible in the region I (see FIG. 5), it is more effective to use the region (1) in which variation of the magnetic field strength distribution of the magnet in the vertical axis direction attenuates to a certain degree as shown in FIG. 11. On the other hand, in order to exert a recorrection force only on the electron beam travelling along the track A in the region II (see FIG. 5), it is more effective to use the region (2) in which variation of the magnetic field strength distribution of the magnet in the vertical axis direction varies sharply.

Figure 13:
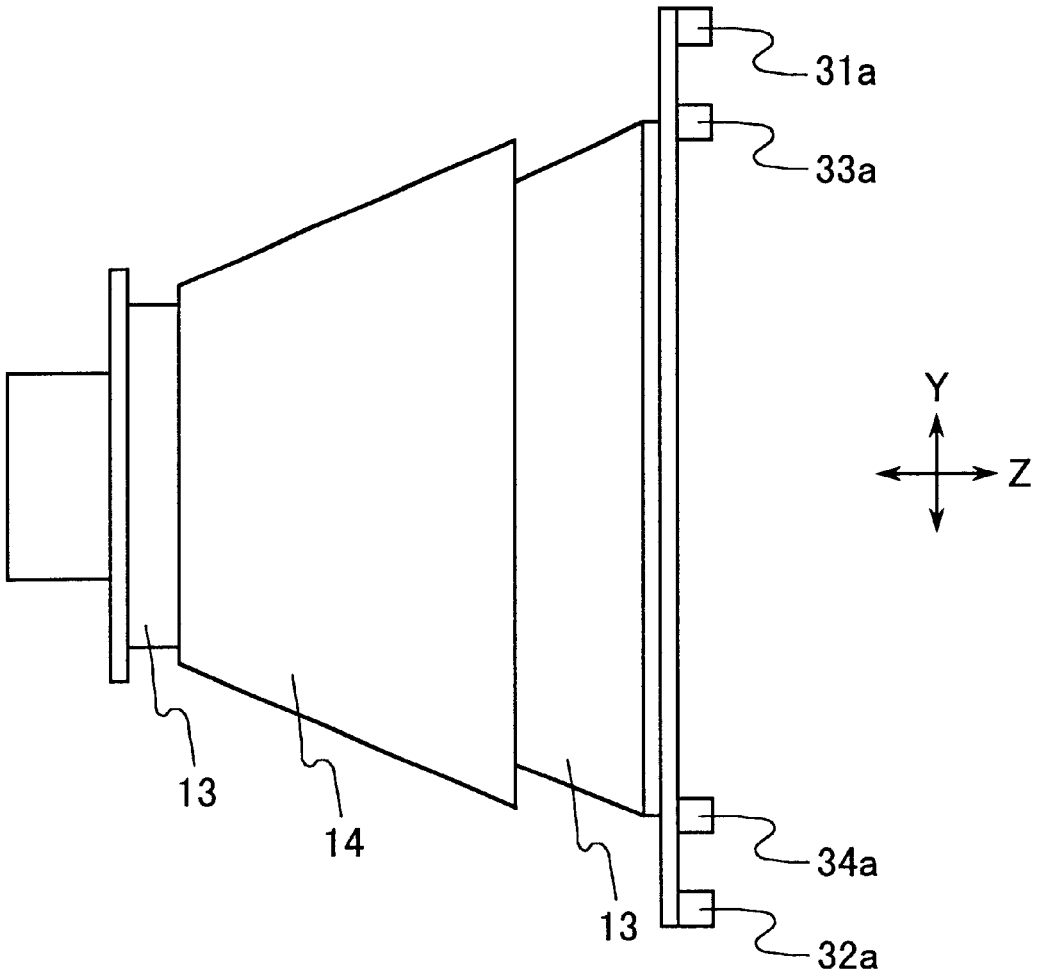
FIG. 13 shows the deflection device of the present invention on which the magnetic field generators (correction magnets) are mounted at the same position in a tube axis direction, seen in the lateral direction.
Figure 14:
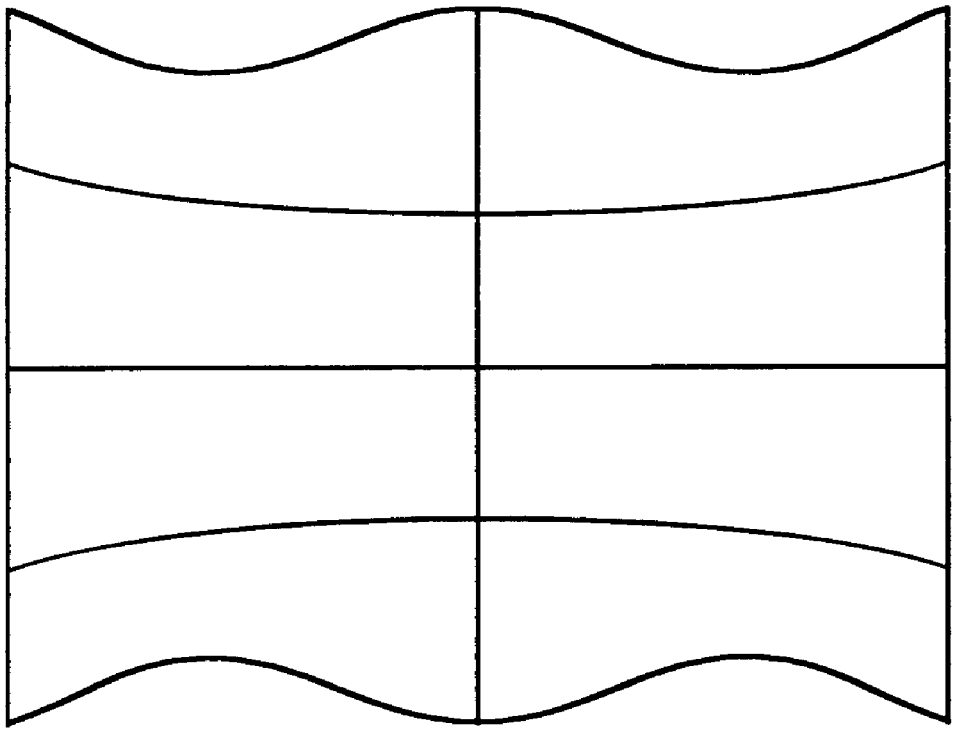
FIG. 14 illustrates a raster having a wavy component in upper and lower edge portions.
Figure 15:
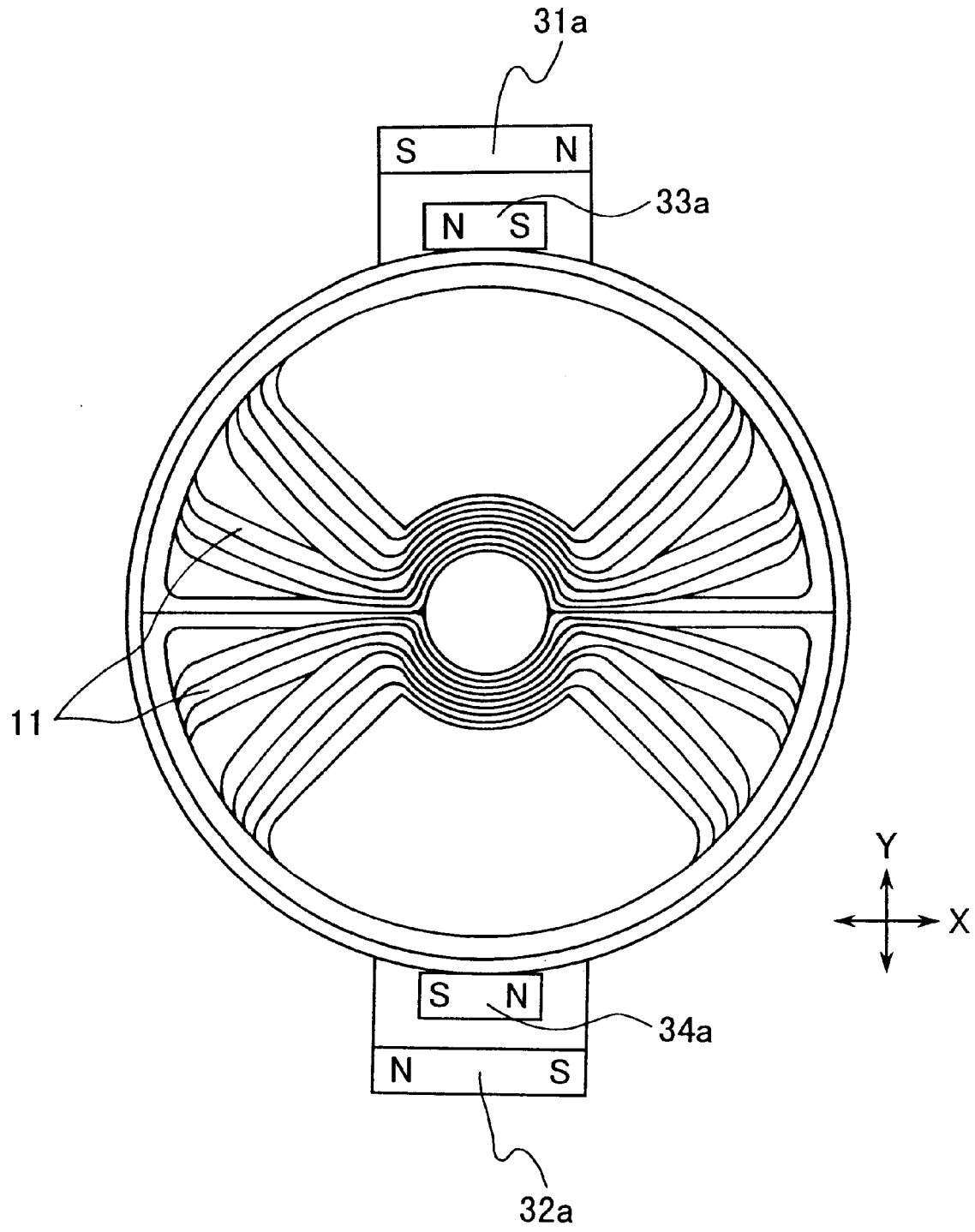
FIG. 15 shows the deflection device of the present invention in which two types of magnets with a different length are used as the magnetic field generators, seen from the side of the phosphor screen.
Figure 16:
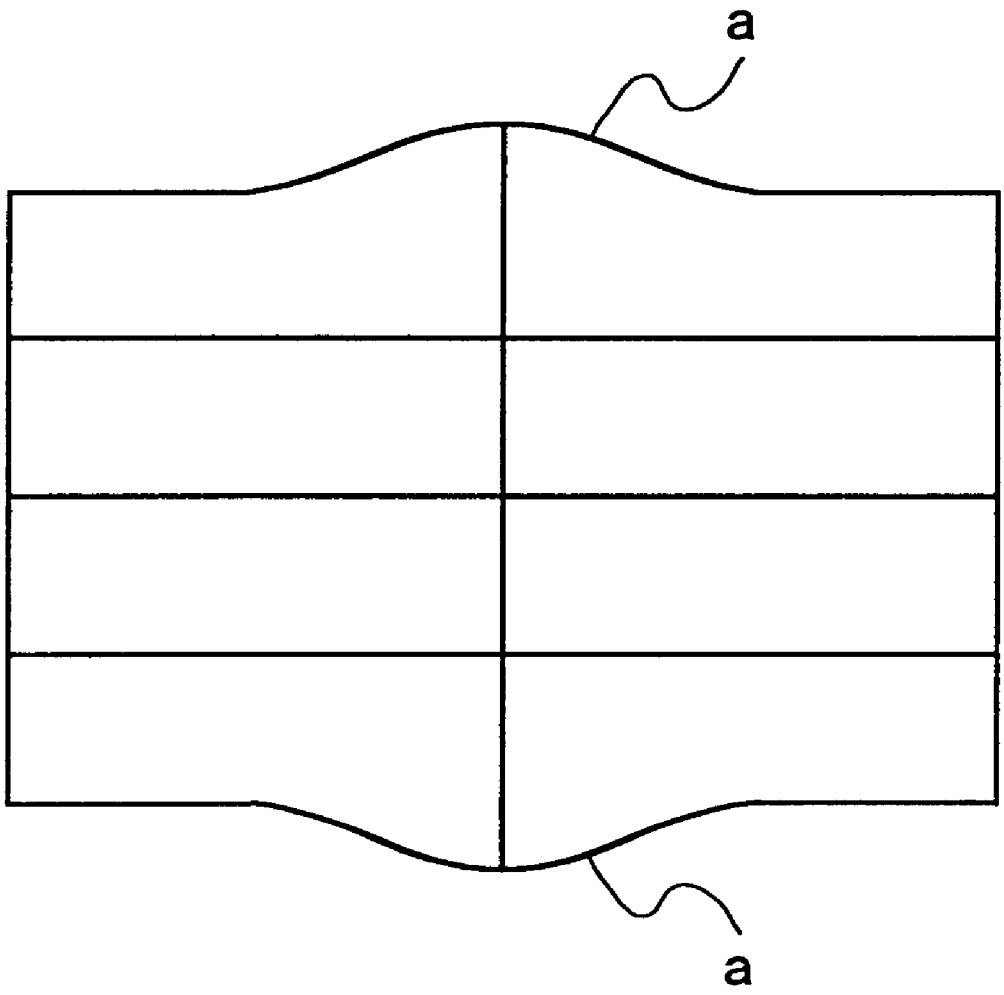
FIG. 16 shows how the upper and lower inner pincushion distortion shown in FIG. 14 is corrected.

Even when a first magnet 31*a* and a second magnet 32*a* are mounted at the same position in the tube axis direction as a third magnet 33*a* and a fourth magnet 34*a* as shown in FIG. 13, by using the magnets 33*a* and 34*a* having a magnetic field strength smaller than the magnets 31*a* and 32*a* and mounting the magnets 33*a* and 34*a* closer to the funnel in the vertical axis direction than the magnets 31*a* and 32*a* are, a similar effect can be obtained. When the upper and lower raster distortion before the correction has a wavy component as shown in FIG. 14 in this case, the first magnet 31*a* and the second magnet 32*a* may be longer than the third magnet 33*a* and the fourth magnet 34*a* as shown in FIG. 15. Accordingly, the first magnet 31*a* and the second magnet 32*a* correct the upper and lower raster distortion as a whole as shown in FIG. 16, and the third magnet 33*a* and the fourth magnet 34*a* correct a convex portion a in the center inversely, thereby removing the wavy component as shown in FIG. 10.

In addition, although the above embodiment used the magnets 31 to 34 (31*a* to 34*a*) as the first to fourth magnetic field generators, electromagnets using coils or the like also may be used instead.

As described above, in accordance with the present invention, it is possible to correct the upper and lower inner pincushion distortion while optimizing the upper and lower pincushion distortion and to provide the color display tube device with a high quality in a simple and low-cost manner.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color display tube device comprising:

a glass bulb having a phosphor screen on an inner surface thereof;

an in-line electron gun that is arranged in the glass bulb and irradiates an electron beam on the phosphor screen; and a deflection device that is arranged outside the glass bulb and has a horizontal deflection coil and a vertical deflection coil;

wherein a first magnetic field generator for generating a magnetic field having a same polarity as a magnetic field generated by the vertical deflection coil during a deflection toward an upper side is provided above a horizontal axis of the deflection device, and a second magnetic field generator for generating a magnetic field having a same polarity as a magnetic field generated by the vertical deflection coil during a deflection toward a lower side is provided below the horizontal axis of the deflection device, a third magnetic field generator for generating a magnetic field having an opposite polarity to the magnetic field generated by the vertical deflection coil during the deflection toward the upper side is provided above the horizontal axis of the deflection device, and a fourth magnetic field generator for generating a magnetic field having an opposite polarity to the magnetic field generated by the vertical deflection coil during the deflection toward the lower side is provided below the horizontal axis of the deflection device, the first and second magnetic field generators are arranged on a side of the phosphor screen with respect to a peak position of a deflection magnetic field strength of the horizontal deflection coil and the vertical deflection coil in a tube axis direction, and the third and fourth magnetic field generators are arranged at a same position as the first and second magnetic field generators or on the side of the phosphor screen with respect to the first and second magnetic field generators in the tube axis direction.

2. The color display tube device according to claim 1, wherein the magnetic field strength of the third and fourth magnetic field generators is smaller than that of the first and second magnetic field generators, and a distance from the third and fourth magnetic field generators to the glass bulb is smaller than that from the first and second magnetic field generators to the glass bulb in a vertical axis direction.

3. The color display tube device according to claim 1, wherein the first to fourth magnetic field generators comprise magnets.

* * * * *